United States Patent [19]

Rosenberger

[11] 4,415,018

[45] Nov. 15, 1983

[54] HEAT TRANSFER APPARATUS FOR TRANSPORTABLE LIQUID CONTAINERS

[75] Inventor: Leonard S. Rosenberger, Saratoga, Calif.

[73] Assignee: Kaydee Engineering, Inc., Saratoga, Calif.

[21] Appl. No.: 269,386

[22] Filed: Jun. 1, 1981

[51] Int. Cl.[3] ..... F28F 9/00

[52] U.S. Cl. ..... 165/41; 105/451; 165/67; 165/69; 165/132; 165/162; 165/163; 237/12.8

[58] Field of Search ..... 165/67, 69, 162, 163, 165/172, 41, 132; 237/12.4, 12.8, 28, 34, 39, 40, 43; 105/360, 392.5, 451

[56] References Cited

U.S. PATENT DOCUMENTS

| | | | |
|---|---|---|---|
| 215,376 | 5/1879 | Leonard | 165/162 |
| 728,430 | 5/1903 | Worth et al. | 237/34 X |
| 833,510 | 10/1906 | Davis | 237/12.8 |
| 1,324,380 | 12/1919 | Bowen | 165/162 |
| 1,370,531 | 3/1921 | Fowler | 105/451 X |
| 1,704,097 | 3/1929 | Muhleisen | 165/162 X |
| 2,166,808 | 7/1939 | Flindt | 165/69 |
| 2,590,465 | 3/1952 | Ris | 165/162 X |
| 3,143,108 | 8/1964 | Rogers | 165/41 X |
| 3,286,079 | 11/1966 | Hynes et al. | 105/451 X |
| 3,389,974 | 6/1968 | Barattini et al. | 165/69 X |
| 3,929,189 | 12/1975 | Lecon | 165/69 |

FOREIGN PATENT DOCUMENTS

| | | | |
|---|---|---|---|
| 104505 | 5/1926 | Austria | 165/132 |
| 13069 | of 1888 | United Kingdom | 237/12.8 |

*Primary Examiner*—Sheldon J. Richter
*Attorney, Agent, or Firm*—Thomas E. Schatzel

[57] ABSTRACT

The present invention is a heat transfer apparatus adapted for installation in a mobile liquid container such as a railroad tank car. The apparatus includes inlet and outlet ports at opposite ends of a continuous finned pipe. The continuous finned pipe extends within the container to provide a surface for conductive heat transfer from the heat transfer fluid flowing through the pipe to the contents of the container.

The continuous finned pipe is provided with shock absorbers and flexible loop portions to prevent damage to the apparatus from inertial shocks to the container. A preferred embodiment is designed particularly for use in railroad tank cars adapted to carry molten sulfur. The apparatus is used to remelt the sulfur, which has solidified in transit, for unloading. The present invention accomplishes this purpose in a shorter time period, more economically and with lower construction and maintenance expense than prior art apparati.

9 Claims, 9 Drawing Figures

HEAT TRANSFER APPARATUS FOR TRANSPORTABLE LIQUID CONTAINERS

BACKGROUND OF THE INVENTION

1. Field of the Invention

This invention relates generally to an apparatus for transferring heat to and from fluids and more particularly to heat transfer apparatus for use in transportable liquid containers such as railroad tank cars and tanker trucks.

2. Description of the Prior Art

Fluid containers, and in particular, large volume tanks are extensively used for transporting fluids in commerce. The most common of these containers are railroad tank cars and tanker trucks. These containers are frequently the most economical for shipping large quantities of materials amenable to flowable loading and unloading.

In many cases it is desirable to transfer heat either to or from the fluids contained in the tank. This may be necessary to heat a material to reduce the viscosity such that it will flow easily or to cool the material down to avoid dangerous situations or to facilitate handling.

One type of material frequently shipped in transportable fluid containers, and particularly in railroad tank cars, is elemental sulfur. One manner utilized for transporting sulfur is to heat it above its melting temperature and to pump it into tanker cars while in liquid form. It is then transported to its destination in the tanker cars. During the transportation, the sulfur will cool to below its melting temperature and, at least partially, solidify. Therefore, it is necessary to reheat and remelt the sulfur prior to unloading. Various apparati have been utilized to remelt solidified sulfur in railroad tanker cars.

One method of heating sulfur contained in tanker cars which has been previously utilized is to arrange a series of ordinary pipes in a tanker car and to pump either heated steam or a heated conductive liquid through the pipes, thus transferring heat to the sulfur in the tanker car. However, this method has been substantially abandoned in recent years due to inefficiency of heating and substantial breakage in the pipes. Railroad cars are frequently subjected to significant inertial shocks during coupling transactions and at other times during use. Thus, the interior pipes, which were welded to the structure of the tanker car, were frequently damaged by the shock. The considerable down time caused by pipe breakage and other damage to the heat transfer system were a major disadvantage.

The method most commonly utilized presently to heat solidified sulfur in railroad tank cars is a series of heating pipes arrayed around the outside of the tanker car itself. These pipes are welded directly to the exterior surface of the tank material. Conductive heat transfer thus takes place between the contents of the pipe, through the pipe wall, through the weld and finally through the tank wall to the contents.

The exterior welded pipe apparatus has significant disadvantages in that a great deal of the heat is dissipated into the environment since only a small portion of the pipe is actually in contact with the tank material. Furthermore, the tank material itself dissipates and radiates outward some of the heat transferred to it. This exterior welded structure has a further disadvantage in that it is difficult to construct because a great deal of welding must be done between the pipes and the tank wall. This results in a large amount of assembly line time being spent on the installation of the exterior pipes. Furthermore, although the pipes are welded to the exterior of the tank, the pipes retain some independent inertia and are subject to some breakage due to the shocks involved in coupling the cars.

None of the prior art apparati for heat transfer in railroad tank cars have solved the problems of eliminating breakage and stress while maximizing the transfer of heat to the contents. These same problems are present and remain unsolved in other mobile liquid containers, as well.

SUMMARY OF THE INVENTION

It is therefore an object of the present invention to provide an apparatus for heat transfer in a mobile liquid container, such as a railroad tank car, wherein the apparatus is installed in the interior space of the container and provides maximum heat transfer efficiency to the contents of the container.

It is another object of the present invention to provide an apparatus for heat transfer which may be easily installed in a container with a minimum amount of production line time.

It is a further object of the present invention to provide an apparatus for heat transfer which is resistant to damage caused by shocks applied to the container.

It is yet another object of the present invention to provide a heat transfer apparatus adaptable for use with different kinds of heat transfer fluids.

Briefly, the preferred embodiment of the present invention is a heat transfer apparatus for installation in a railroad tank car. The apparatus includes an inlet port extending through the wall of the tank car through which heat transfer fluid may be introduced to the apparatus. The apparatus further includes a continuous finned pipe, a portion of which extends in a substantially planar array of parallel open loops in the interior of the tank car. The continuous pipe culminates in an outlet port. The planar loop array is tilted from the horizontal such that the side of the array nearer the inlet port is at a higher elevation than that nearer the outlet port. The pipe array is supported on a series of supports for each pipe segment. The supports are unrestricted along the axis of motion of the tank car such that the entire array has freedom of movement along that axis. At each end of the array the pipe loop array is provided with a plurality of shock absorber mechanisms which absorb and damp inertial shocks applied to the tank car and prevent damage to the pipe array. The sections of pipe leading to the inlet port and the outlet port and provided with shock absorbing loops to avoid breakage. The inlet and outlet shock absorbing loops are supported by platforms situated above and below the planar array, respectively. The apparatus further includes a thermowell for easy measurement of the temperature of the tank contents.

It is an advantage of the present invention that the pipe array is substantially suspended within the fluid content medium of the tank car and thus provides maximum heat transfer conductance from the pipe array to the contents.

It is a further advantage of the present invention that the finned pipe utilized greatly increases the efficiency of heat transfer to the tank contents.

It is another advantage of the present invention that the pipe array may be constructed substantially in a modular manner outside of the tank car and then installed as a unit within the car, thus minimizing the amount of production line time spent on the heat transfer apparatus.

It is yet another advantage of the present invention that the shock absorber mechanism and the inlet and outlet shock absorbing loops minimize the amount of breakage occuring during use of the tank car and thus substantially reduce repair costs and down time.

It is still another advantage of the present invention that the heat transfer fluid pumped into the apparatus from the inlet port will gravity drain through the array to the outlet port, thus minimizing the amount of fluid retained within the array between usages.

It is another advantage of the present invention that the superior heat transfer characteristics of the pipe and the array location allow for minimization of the amount of pipe utilized such that it is economically feasible to utilize liquid heat transfer fluids as well as compressed steam as a heat transfer fluid.

These and other objects and advantages of the present invention will no doubt become clear to one skilled in the art upon reading the following detailed description of the preferred embodiment which is illustrated in the several figures of the drawing.

IN THE DRAWINGS

BRIEF DESCRIPTION OF THE PREFERRED EMBODIMENT

Figure 1:
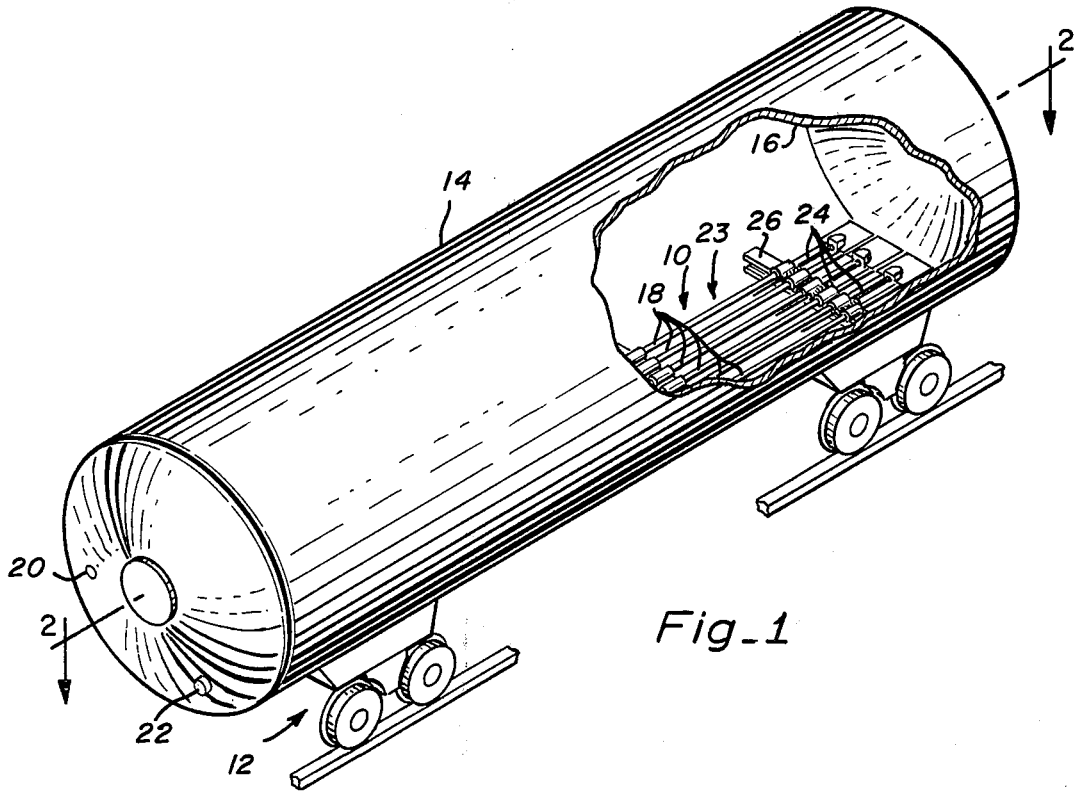
FIG. 1 is a perspective view of a railroad tank car, partially cut-away to show a heat transfer apparatus installed therein.

The present invention is an apparatus for heat transfer to the contents of a mobile container, and is particularly directed toward railroad tank cars. A preferred embodiment of the heat transfer apparatus, specifically intended for use with molten sulfur tank cars, is illustrated in the drawing and is designated by the general reference character 10.

Referring now to FIG. 1, the heat transfer apparatus 10 is shown as installed in the interior of a railroad tank car 12. The tank car 12 includes a tank 14 having a tank wall 16. In this perspective view a portion of the tank wall 16 has been cut-away to show the heat transfer apparatus 10 installed within the tank 14.

As more clearly shown in FIGS. 2 through 6, the heat transfer apparatus 10 includes a continuous heat transfer pipe 18 extending from an inlet port 20 to an outlet port 22. The inlet port 20 and the outlet port 22 are accessable from the end wall of the tank 14.

Figure 2:
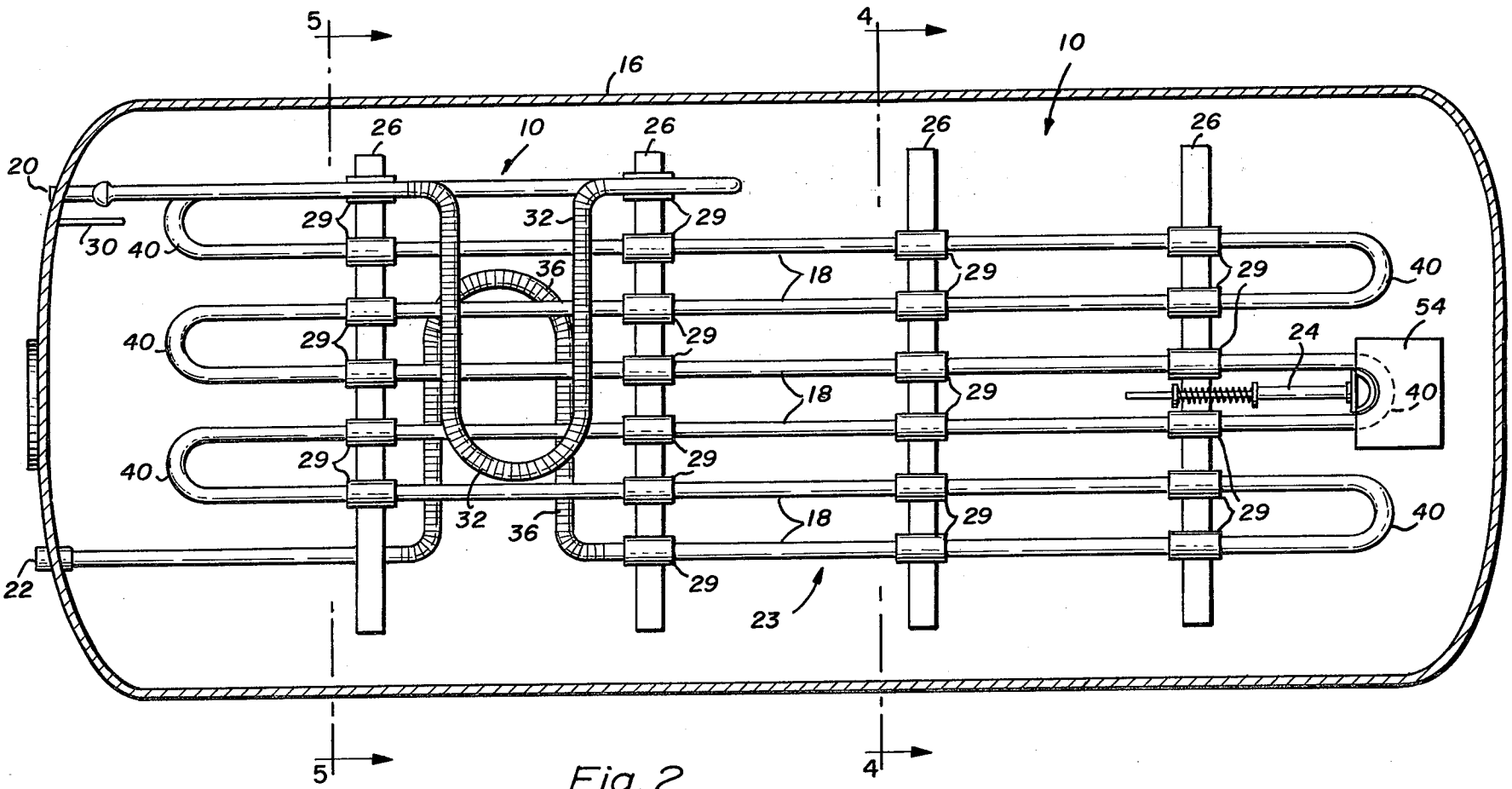
FIG. 2 is a top plan view of a cross-section taken along line 2–2 of FIG. 1, illustrating the array of pipes within the tank car.

FIG. 2 is a top plan view of the heat transfer apparatus 10 installed within the tank 14 and shown as a cross-section of the tank taken along the line 2—2 of FIG. 1. The pattern of the loop array 23 of the continuous heat transfer pipe 18 is particularly illustrated. The loop array is a continuous series of open loops lying in the same tilted plane.

Situated at the ends of each of the open loops in array 23 are a plurality of shock absorber mechanisms 24. One shock absorber mechanism is situated within the U-shaped end portion of each open loop. In FIG. 2, for clarity, the shock absorber mechanism 24 is shown in only one of the six loop ends of the pipe 18. The shock absorber mechanism 24 is illustrated in greater detail in FIGS. 6 and 7. Portions of the pipe support structure are also omitted from FIG. 2. The majority of the length of pipe 18 is contained in the loop array 23. The loop array is supported and maintained in position by a support structure illustrated particularly in FIGS. 3 and 4. The support structure includes a plurality, in this embodiment four, of lateral support beams 26 extending across underneath the straight parallel segments of pipe 18. The lateral support beams 26 are attached at their ends to the tank wall 16 and are further supported from below by a series of support posts 28.

The segments of pipe 18 are laterally restrained on the lateral beams 26 by loose pipe sleeves 29. Each pipe sleeve 29 is welded to the lateral beam 26. The pipe sleeves 29 are of greater diameter than the pipe 18 to allow the respective segment of pipe 18 to slide longitudinally but to restrain it in other dimensions.

Figure 3:
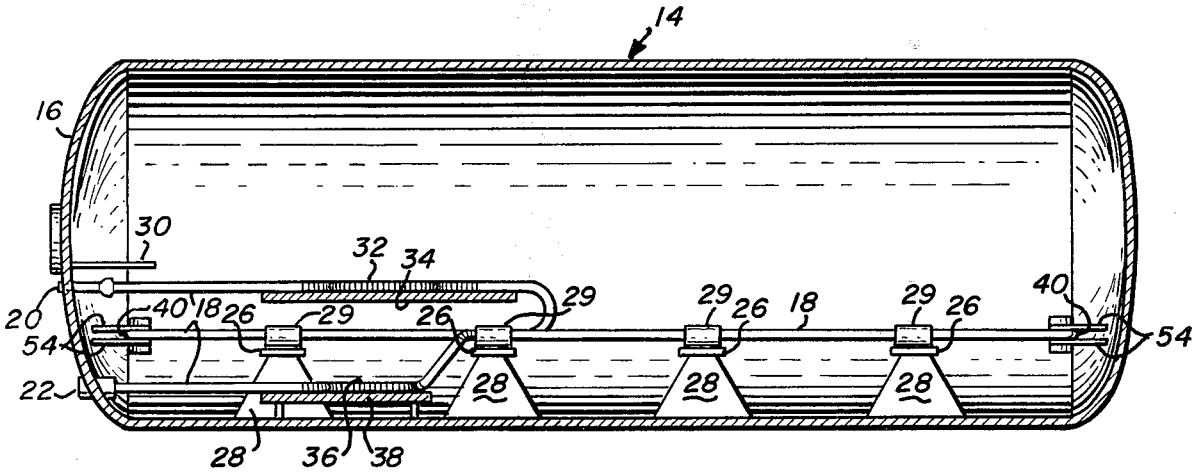
FIG. 3 is a side elevational view of the tank with the front surface cut-away to show the interior.

The illustrations of FIGS. 2 and 3 show the manner in which the heat transfer apparatus 10 is arrayed within the interior of tank 14, particularly showing the shape of the convolutions of the continuous heat transfer pipe 18. The inlet port 20 is situated at one end of the continuous heat transfer pipe 18 and provides an opening through which heat transfer fluid, such as super heated steam or heated liquids may be introduced into the pipe 18.

Situated near inlet port 20 is a thermowell 30. Thermowell 30 is an elongated sealed channel extending into the interior of tank 14. The thermowell 30 is designed to provide for easy measurement of the ambient temperature within tank 14 by the insertion of a temperature measuring device into the interior of the thermowell 30. This sort of measurement is necessary to determine the amount and temperature of heat transfer fluid to be utilized with the apparatus to accomplish the necessary reheating.

From the inlet port 20, the pipe 18 continues into the tank for a short distance and is then attached to an inlet shock absorbing loop 32. Inlet shock absorbing loop 32 is a length of flexible tubing designed to absorb inertial shocks in those portions of the pipe 18 closest to the inlet port. Such a shock absorbing loop is necessary since the pipe 18 is rigidly connected to the tank wall 16 at inlet port 20 and it is necessary for prevention of breakage, that the pipe loop array 23 not be rigidly attached to the tank wall 16.

Figure 5:
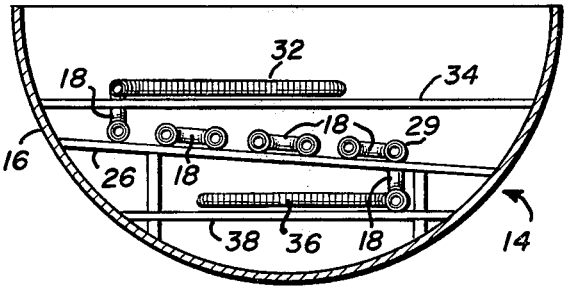
FIG. 5 is an end elevational view of a cross-section taken along lines 5—5 of FIG. 2.

As can be seen in FIGS. 3 and 5, the inlet port 20 is situated above the plane of the loop array 23. Therefore, the support structure does not directly support this portion of the apparatus 10. Consequently, the inlet shock absorbing loop 32 and the pipe 18, on either end thereof, are supported upon an inlet loop support platform 34, as illustrated in FIGS. 3 and 5. Since the inlet loop 32 is necessarily of a flexible material rather than the rigid finned pipe 18, the inlet support platform 34 is necessary to maintain the inlet loop 32 in position.

Subsequent to inlet shock absorbing loop 32 the continuous pipe means 18 continues around a downward U-turn and enters the planar loop array 23. The pipe 18 is arrayed in a series of open parallel loops having their main axes aligned with the direction of motion of the tank car 12. The end portions of the loops are U-shaped while the central portions are parallel segments of straight pipe 18. The shock absorber mechanisms 24 are installed in each of the U-shaped end portions of the loop array 23. The loop array 23 extends in a tilted plane across the width of the tank such that a significant portion of the volume of the tank is in direct contact with the finned pipe 18 in the loop array 23.

As is shown particularly in FIG. 3, the lateral support beams 26 are situated well above the bottom of tank 14 such that the loop array 23 is fully within the interior of the tank 14 and the pipe 18 does not contact the tank walls 16 at any points other than the inlet port 20 and the outlet port 22.

After the loop array 23 the pipe 18 extends downward, as shown in FIGS. 3 and 5, and enters an outlet shock absorber loop 36 situated beneath the plane of loop array 23. Outlet loop 36 is similar in structure and purpose to inlet loop 32. Outlet loop 36 is supported on an outlet loop support platform 38. From the outlet loop 36 the pipe 18 continues to the outlet port 22 where it is rigidly attached to the end of the tank 14.

Figure 4:
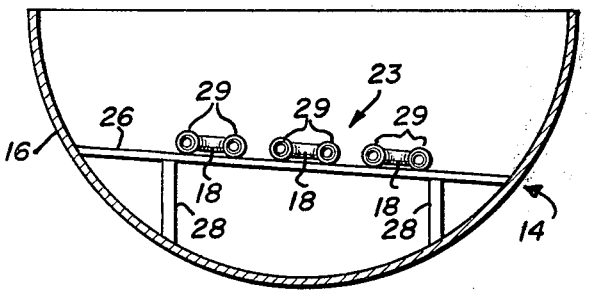
FIG. 4 is an end elevational view of a cross-section taken along lines 4—4 of FIG. 2.

FIG. 4 is a cross-section taken along line 4—4 of FIG. 2 illustrating the manner in which the loop array 23 is laterally tilted. In this illustration, it may be seen that the support beams 26 are not horizontal with respect to tank 14, but are mounted on a slight slant. Thus, the pipe segments on the side of the array 23 nearest the inlet port 20 are at a higher elevation than the pipe segments on the side of the outlet port 22 when the tank car is on a level surface. This orientation provides for gravity draining of the heat transfer fluid through the continuous pipe array.

FIG. 4 further illustrates the manner in which the segments of the pipe 18 are held in position on the lateral support beams 26 by pipe sleeves 29. The pipe sleeves 29 are welded to the support beams 26 and surround each pipe segment such that they restrain the segment from lateral movement but allow the pipe to slide longitudinally within the sleeve 29. The pipe sleeves 29 thus hold the array 23 in position vertically and laterally but allow absorption of longitudinal inertial shocks by the shock absorber mechanisms 24. If the pipe sleeves 29 were too tight, inertial shocks would be transferred directly to the support beams 26. These shocks could damage the pipes, welds and other structural portions of the apparatus 10.

FIG. 5 is a cross-sectional view taken along line 5—5 of FIG. 2 illustrating the vertical relationship of the inlet portions of the pipe 18, the loop array 23 and the outlet portions of the apparatus 10. This figure shows that the inlet support platform 34 and the outlet support platform 38 are substantially horizontal while the lateral support beams 26 are not. FIG. 5 also illustrates that the inlet shock absorbing loop 22 and the outlet shock absorbing loop 36 are shaped differently from the pipe 18. The shock absorbing loops 32 and 36 are constructed of flexible material for absorbing the inertial shocks delivered to the tank 14. This figure also illustrates the gravity drainage aspects of the apparatus 10.

Figure 6:
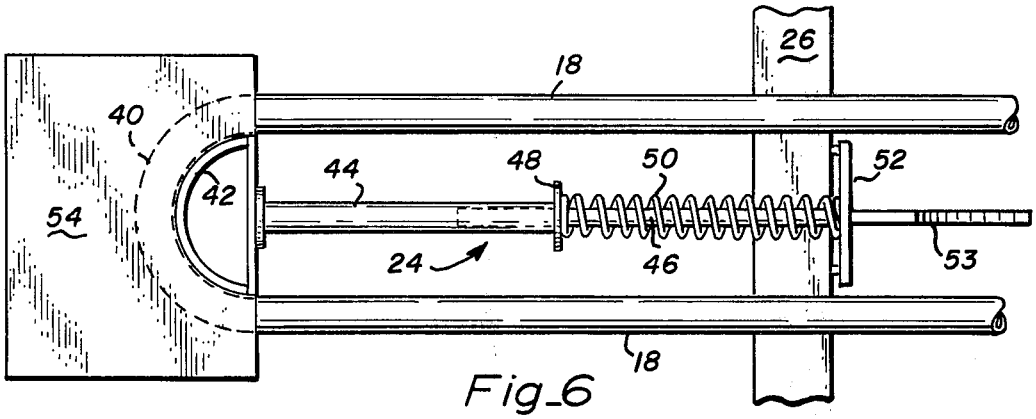
FIG. 6 is a top view of shock absorber mechanism for the pipe array.
Figure 7:
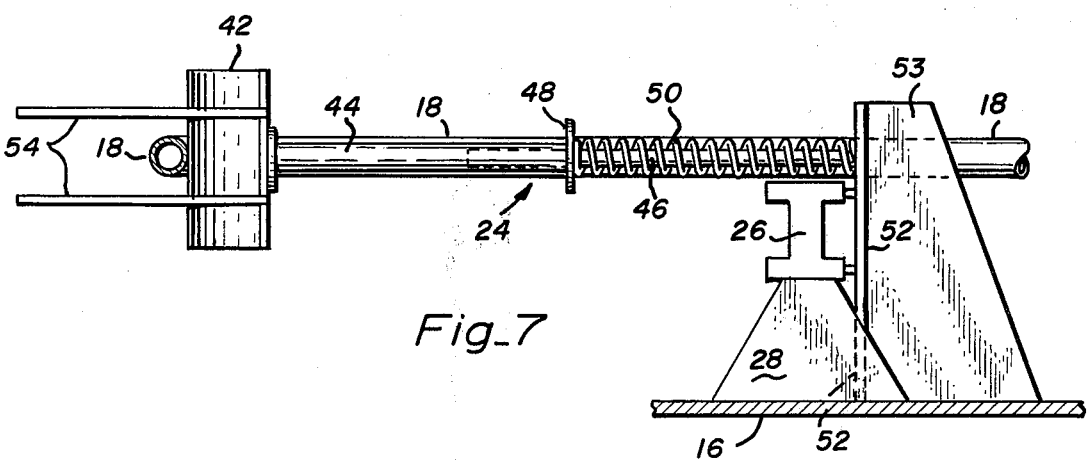
FIG. 7 is a side elevational view of the shock absorber mechanism.

The shock absorber mechanisms 24, as particularly illustrated in FIGS. 6 and 7, are designed to damp the motion of the pipe array 23 along the axis of motion of the tank 14. The shock absorber mechanisms 24 are installed between the end support beams 26 at each end of the tank 14, as shown in FIG. 2, and the U-shaped ends 40 of the pipe 18 within loop array 23.

Each shock absorber 24 includes a curved abutment plate 42 for engaging the interior surface of the U-shaped loop end 40. The curvature of abutment plate 42 is the same as the interior curvature of the pipe 18 at the U-shaped end 40 such that an abuttment over a significant portion of the U-shaped end 40 is achieved. Abutment plate 42 is attached to an outer cylinder 44 into which telescopes an inner cylinder 46. The end of outer cylinder 44 opposite abutment plate 42 is provided with a spring plate 48. A compression spring 50 surrounds the inner cylinder 46 and abuts at one end against spring plate 48 and at the other end against a support plate 52. Support plate 52 is attached to support beam 26 and extends downward to attach to tank wall 16. The support plate 52 holds the shock absorber mechanism 24 in the proper orientation with respect to the loop end 40 for maximum contact and linear force absorption. Support plate 52 is further supported by a gusset plate 53 attached to the back surface thereof and anchored to the tank floor 16.

The longitudinal dimensions of outer cylinder 44 and compression spring 50 are selected such that compression spring 50 is somewhat preloaded or compressed when the loop array 23 is in equilibrium position.

A pair of positioning plates 54 are attached to the abutment plate 42 at a vertical separation greater than the outside diameter of pipe 18. Positioning plates 54 are designed to hold the pipe 18 in vertical alignment with the cylinders 44 and 46 and in constant contact with the abutment plate 42.

The shock absorbers 24 are designed to absorb the shocks delivered to the pipe array 23 by coupling or lurching of the tank car 12. The helical compression spring 50 is selected to absorb up to six inches of motion while absorbing a 15 gravity shock, and 7.2 inches at 18 gravities prior to forming a solid block.

Figure 8:
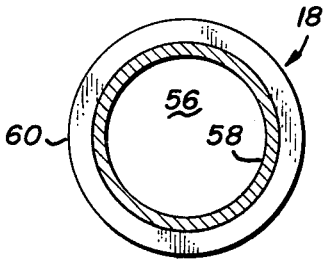
FIG. 8 is a radial cross-sectional view of the finned pipe utilized in the array.
Figure 9:
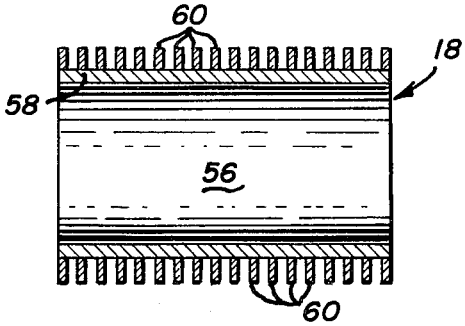
FIG. 9 is an axial cross-sectional view of the finned pipe.

The finned pipe 18 utilized in the preferred embodiment is illustrated in FIGS. 8 and 9 in radial and axial cross-sections, respectively. The pipe selected is a fin-type pipe designed for maximum heat transfer to a material surrounding the pipe. The pipe 18 includes a central fluid channel 56 through which the heat transfer fluid flows. The fluid channel is cylindrical in nature and is encompassed by a pipe wall 58. A plurality of fins 60 are welded in a spiral manner about the outside surface of pipe wall 58. The pipe wall 58 and the fins 60 are constructed of highly heat conductive material such that the heat is readily transferred from the heat transfer fluid in the channel 56 to the contents of the tank 14 surrounding the pipe 18.

The planar loop array 23 and the lateral support beams 26 form a continuous unitary structure. This structure, with the shock absorbers 24 already installed, may be assembled as a unit in facilities separate from the tank manufacturing assembly line facilities. Then, the entire unit may be installed within the tank at the proper stage. In this manner, the assembly line time for the construction of the tank car is minimized. Furthermore, this unitary construction makes it easy for an existing tank car to be converted to one including the heat transfer apparatus 10.

The pipe 18 selected for use in the preferred embodiment is two inch diameter, Schedule 80, carbon steel pipe-A53, Grade B. The fins are constructed of a strip of carbon steel welded in continuous spiral around the outside of the pipe wall. The fins are three quarters inch in height by 0.06 inch thick and are spaced at approximately five fins per inch. It has been observed that the heat transfer resulting from utilizing the finned pipe 18 is approximately eleven times greater than the heat transfer for the same pipe without the fins attached.

It is noted that the shock absorbers 24 are arrayed such that three shock absorbers are situated at each end of the loop array 23. Each of the shock absorbers 24 operates independently from the others. In the event that the tank car 12 is impacted from one end the shock absorbers 24 situated at that end will absorb the inertial motion of the pipe array 23. When the compression springs 50 expand subsequent to absorption, the pipe array 23 will be displaced in the opposite direction, thus bringing the shock absorbers 24 at the opposite end into play. The complimentary action of the shock absorbers 14 at the opposing ends of the tank will thus smoothly damp the motion of the pipe array 23 within the tank caused by an inertial shock and will prevent damage to the apparatus 10. The flexible inlet shock absorbing loop 32 and outlet shock absorbing loop 36 prevent any damage caused by rigid connections between the pipe array 23 and the tank wall 16.

The preferred embodiment is utilized by installing it within a railroad tank car, specifically a tank car intended for carrying molten sulfur. Sulfur is an element having a melting point of approximately 119° C. (246° F.). In operation, the sulfur is heated to a liquid form and loaded within the railroad tank car for transportation. The travel time from initiation point to destination for a tank of sulfur may be several days. Since it is impractical to heat the contents while the tank car is in transit, the contents tend to cool and solidify. Thus, it is necessary to reheat the contents at the destination in order to effectively unload the tank car.

When the tank car reaches its destination, the inlet port is hooked up to a supply of heat transfer fluid which has been heated to a preselected temperature in excess of the melting point of the sulfur. The heat transfer fluid utilized may be compressed heated steam or may be a high boiling point liquid. When steam is utilized the steam is typically in saturated form at approximately 218° C. (425° F.) and about twenty-two atmospheres (325 lbs/in$^2$) (306 psig). The preferred liquid heat transfer fluid is Therminol 55, a commercially available product manufactured by Monsanto Chemical. When Therminol 55 is utilized it is heated to between 163° C. (325° F.) and 218° C. (425° F.).

After hook-up the heat transfer fluid is then pumped through the continuous pipe means 18 of the heat transfer apparatus from the inlet port 20 to the outlet port 22. The total interior volume of the heat transfer apparatus 10 of the preferred embodiment is approximately 175 liters (46.2 gallons). The fluid is pumped through the apparatus at a rate of 2.44 m/sec. (8 ft./sec.) at a pressure of 1.35 atmospheres (20 lbs/in$^2$) for Therminol 55. Steam is pumped at the same rate but at a pressure of about 22 atmospheres (325 lbs/in$^2$) (360 psig). While the heat transfer fluid is contained therein, the fin-type pipe conductively transfers the heat from the heat transfer fluid to the contents of the tank car. The typical molten sulfur tank car has a cylindrical tank 10.06 meters (33 ft.) in length with a diameter of 2.44 meters (8 ft.). Such a tank has a capacity of $4.98\times10^4$ liters (13,166 gal.) or about $8.96\times10^4$ kg (197,500 lbs) of molten sulfur.

During a typical journey from a sulfur deposit of eleven days travel from the destination in midwinter, a molten sulfur tank car will loose approximately $1.26\times10^9$ calories (5 million BTU) in heat. This heat loss results in the solidification of about a 0.61 meter (2 foot) layer about the outside of the sulfur. A 1.22 meter (4 foot) diameter core of molten sulfur will remain through the center of the tank. When the sulfur in contact with the pipe becomes liquid it will flow and transfer heat to the remaining solidified sulfur within the tank. Thus, the entire contents of the tank are gradually remelted. For the typical tank described above the prior art methods would require at least thirty hours of heat transfer treatment to remelt all of the sulfur for proper unloading. With the apparatus of the present invention this time can be reduced to about ten hours. It has been calculated that utilization of an apparatus of the present invention will reduce the time necessary to remelt a tank car full of sulfur to about one third in most circumstances.

When the remelting process has been completed, the heat transfer fluid will gravity drain through the continuous pipe and will be collectable at the outlet port.

Since the total volume of pipe contained in the apparatus of the preferred embodiment is significantly less than the volume of prior art techniques, the amount of heat transfer fluid necessary is greatly reduced. Thus, it is feasible to utilize liquid heat transfer fluids as well as the compressed heated steam as the heat transfer fluid.

The support structure in the preferred embodiment is constructed of structural steel capable of withstanding the temperatures involved and impervious to corrosion from molten sulfur. The components of the shock absorber means are similarly selected for strength and resistance to corrosion.

Although the present invention has been described in terms of the present preferred embodiment, it should be understood that such disclosure is not to be considered as limiting. Accordingly, it is intended that the appended claims be interpreted as covering all alterations and modifications which fall within the true spirit and scope of the invention.

I claim:

1. An apparatus for providing heat transfer to the contents of the mobile tank comprising:

an inlet port;

a flexible inlet loop attached at one terminal end to the inlet port;

a continuous pipe means attached to the second terminal end of the inlet loop, said continuous pipe means including a planar array of a plurality of parallel open loops extending within the tank along the tank's axis of motion;

a flexible outlet loop, having a first terminal end attached to the opposite end of the continuous pipe means and having a second terminal end attached to an outlet port;

a support structure, rigidly engaged with the tank and slidably engaged with the pipe means; and shock absorbing means engaged with the continuous pipe means.

2. An apparatus according to claim 1 wherein the plane of said array of parallel open loops is tilted slightly from horizontal and higher on the side of the inlet port to lower on the side of the outlet port.

3. An apparatus according to claim 1 wherein the end portions of said parallel open loops are U-shaped while the central portions of the loops comprise parallelly, arrayed segments of the pipe means.

4. An apparatus according to claim 3 wherein the support structure includes a plurality of support posts attached at one terminal end to the lower tank wall and attached at their upper terminal ends to a plurality of lateral support beams, said beams extending transversely across and under said planar array of parallel open loops such that said array is supported thereon, and said lateral support beams further include a plurality of pipe sleeves attached to said beams, said sleeves being of greater diameter than said pipe segments and loosely extending around said pipe segments of the pipe means to allow the pipe means to slide within said sleeves along the axis of said pipe segments while restricting motion of the pipe means in other dimensions.

5. An apparatus according to claim 1 wherein the shock absorbing means includes a plurality of biasing means abutting at one end against the inside of said U-shaped ends of the parallel loops and restrained by a support plate at the opposite end such that said biasing means is compressible between said loop end and support plate.

6. An apparatus according to claim 5 wherein said biasing means comprise a pair of telescoping cylinders with a compression spring installed about the smaller cylinder to restrict the degree of telescoping; a curved abutment plate for abutting against the interior curve of one of said U-shaped ends attached to the external end of one of said telescoping cylinders; and a support plate attached to the external end of the other said cylinder and to the support structure to retain said biasing means in position.

7. An apparatus according to claim 6 wherein each of said biasing means is arrayed such that the abutment plate abuts against said U-shaped ends so as to preload said compression spring such that said array of parallel open loops is flexibly supported along the axis of motion of the container by the opposing shock absorbing means at the opposite ends of said loops.

8. An apparatus according to claim 1 and further including, a thermowell extending into the interior of said tank and situated near the inlet port.

9. An apparatus according to claim 1 wherein the continuous pipe means is comprised of finned carbon steel pipe.

* * * * *